US005123655A

United States Patent [19]

Rones

[11] Patent Number: 5,123,655

[45] Date of Patent: Jun. 23, 1992

[54] SAILING DISK AND CATCH GAME

[76] Inventor: James M. Rones, P.O. Box 10000, Atlanta, Ga. 30101

[21] Appl. No.: 756,253

[22] Filed: Sep. 6, 1991

[51] Int. Cl.[5] ..... A63B 67/06

[52] U.S. Cl. ..... 273/346

[58] Field of Search ..... 273/346, DIG. 30

[56] References Cited

U.S. PATENT DOCUMENTS

| | | | |
|---|---|---|---|
| 3,370,853 | 2/1968 | Feld et al. | 273/346 |
| 4,049,271 | 9/1977 | Fonti | 273/346 |
| 4,113,251 | 9/1978 | Imes, Jr. | 273/346 |
| 4,789,161 | 12/1988 | Waskelo | 273/346 X |

*Primary Examiner*—William H. Grieb

*Attorney, Agent, or Firm*—Sughrue, Mion, Zinn, Macpeak & Seas

[57] ABSTRACT

A sailing disk and catch game is formed of at least one hand held catch baton having on a distal end a strip fixable attached about the periphery of the rod with radially projecting short length hooks on a radially outer surface of the strip. A thin, hand throwable sailing disk consists of a unitary, light weight semi-rigid, soft highly porous non-woven plastic fiber material with the exposed plastic fibers on the surface thereof constituting with the short length hooks of the baton strip, a two component hook and loop releasable fastening system. The game is readily applicable to indoor play since the sailing disk weighs at the most several ounces and has little impact force when thrown in the style of a FRISBEE® sailing disk, for catching during flight by the hand held catch baton.

7 Claims, 1 Drawing Sheet

FIG 1
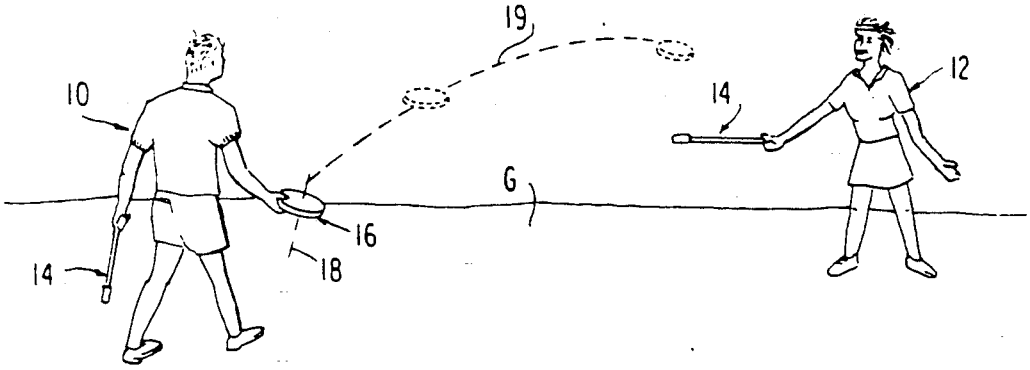
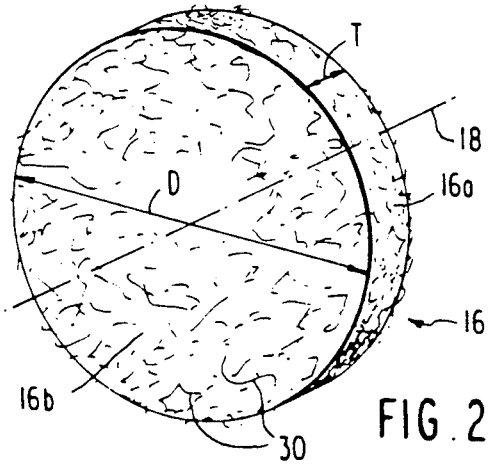
FIG. 2
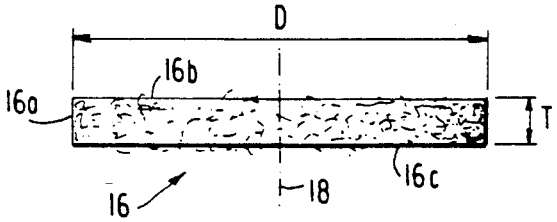
FIG. 3
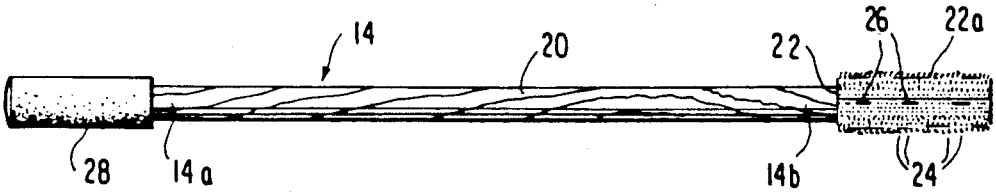
FIG. 4

SAILING DISK AND CATCH GAME

FIELD OF THE INVENTION

This invention relates to hand thrown sailing discs which are of generally planar form which are caused to rotate about their axis when thrown and which travel over distances of tens of yards, and which may be readily grasped or caught by the hand of another person some distance from the thrower, and more particularly, to such a sailing disc and catch game in which the sailing disc is formed of a soft, light weight material of unitary form for use indoors, and which may readily constitute one a of two component hook and loop fastening system.

BACKGROUND OF THE INVENTION

Such hand thrown sailing discs have become popular over the years, and are often thrown between multiple players on an ocean beach or the like. Such conventional sailing discs are formed of rigid molded plastic, configured like a saucer with an offset rim which facilitates grasping of the sailing disc and maintaining of the sailing disc in inverted saucer position, and when thrown with a circular rotation about the vertical axis of the disc, results in extended flight as a result of the aerodynamic form of the molded plastic sailing disc. A very popular form of solid molded plastic sailing disc, is sold under the trademark FRISBEE®. While such thin molded plastic, saucer like sailing discs, are capable of extended flight, and may be readily thrown over tens of yards outdoor, they are formed of hard plastic and cannot be used inside the home as they have a relatively uncontrolled flight and would impact against articles of furniture and particularly fragile objects such as lamps, vases etc. Further, such hard plastic inverted saucerlike, thin solid, molded plastic sailing discs are difficult to grasp by the catcher when sailing at high speed from a thrower to the catcher, and the failure to grasp the disc contributes to the inability of such sailing disc to be used indoors, particularly in a home or other furniture-filled building structure.

In recent years, there has developed a two component hook and loop releasable fastening system consisting of sheets of engageable fabric. Interengagement of the outer surfaces of these sheets is effected by one of the material sheets having a multiplicity of small, outwardly projecting flexible, filamentary loops and a second sheet having a multiplicity of small, outwardly projecting flexible filamentary hook members on facing surfaces thereof. When such sheets are pressed into contact with one another, the hook members on one sheet engage releaseably with the loops of the other sheet thereby coupling the strips or sheets together.

There is a vast variety of uses for such two component hook and loop fastening system, principally in the apparel field where, the fastening system acts as closures for closing cuffs, collars, waist bands and other areas of wearing apparel as well as closing overlapping uppers of shoes, boots and the like.

In the toy and game field, there have been applications of such two component hook and loop fastening system. Representative of such toys or games, are certain patents dealing with projectiles.

U.S. Pat. No. 3,370,853 is directed to a projectile used in staging a bloodless bull fight. A sheet of material having an outer surface from which projects a plurality of short length loops, is mounted to the body of the bull and forms a moving target. A banderilla projectile of some several feet, simulating a spear, takes the form of a rod, and remote from one end of the rod used as a handle for throwing of the banderilla, has, a terminal end wrapped with a sheet of flexible material, from an inner surface adhered at right angles to the end of the rod. The sheet is thus perpendicular to the rod axis. The opposite, outer surface of the sheet carries a series of outwardly projecting filamentary hooks constituting the second of a two component hook and loop fastening system.

Upon impact, of the terminal end sheet attaches by way of the hooks to the loops of the sheet borne by the bull and functioning as a target. Of course, should the banderilla miss the target area, it falls to the ground. The interlocking and adhering action due to the engagement of the hooks and the loops ensures that the raging bull cannot readily cause the dislodgement of the projectile from the target after adhering therebetween.

In U.S. Pat. No. 4,789,161 two or more players, each grasp respective propel and catch devices in the form of a bat by way of a flexible handle made of rubber, plastic urethane or the like. The urethane handle has an outer, larger diameter tapered portion of the propel and catch device, padded and with an outer surface formed by a cover which carries one of a two component hook and loop type fastening system such as a plurality of short length of the hooks extending radially outwardly of the cover sheet material. The second of the two component loop and hook fastening system is a projectile in the form of a sphere or ball also covered by an outer cover containing the second component of the two component fastening system such as a plurality of short length loops extending radially outwards, over the entire periphery of the sphere.

The propel and catch game is played by initially attaching the ball to the bat. Upon swinging the bat, the ball is caused to leave the bat as a projectile whereby the ball is tossed towards the second player. The flexible handle causes flexing of the distal end of the propel and catch device, throwing the ball from its hook and loop attachment to the bat at a relatively high speed. The opposing player moves his propel and catch device into the path of the airborne ball, such that the loops on the outer surface of the ball or sphere, upon impact with the hooks of the second players propel and catch device. The projectile partially collapses upon contact with the propel and catch device, and adheres thereto.

U.S. Pat. No. 4,049,271 is directed to a target board sail game in which a large circular form target board, which may be several feet in diameter, is set up at some distance from a player armed with a number of sailing missiles which are generally on the order of three to six inches in diameter. Those sailing missiles are formed of a disc having a peripheral rim extending perpendicularly from the edge of the disc to give the missile the shape of an upwardly open pie pan with a continuous circular vertical rim. The outer surface of the rim is covered with a fabric hook tape forming one component of a two component hook and loop fastening system. The pie pan type missiles are thrown in the direction of the target board, and the target board is covered with an external layer of compacting wool, fur hair or plastic fibers in the manner of felt, which layer forms the second component of the hook and loop type fastening system. The fabric tape on the periphery of the pie pan type sailing missile maintains the periphery of the rim in contact with the face of the target aboard upon impact between the two elements of the game. The pie plate may be formed of solid molded plastic or metal.

While the patents discussed above show applications of a two component loop and hook fastening system to active games or sports in which a projectile is caused to impact against another object, the patents are not directed to the type of game components which may be readily thrown and caught interiorly of the home without great danger to furniture and other fragile objects within the vicinity of the player or players. Further, the components of the systems described are complex and costly.

It is therefore a primary object of the present invention to provide an improved, low cost sailing disc and catch game in which the components of the game are relatively inexpensive, the game can be safely played indoors, and the missile or sailing disc thereof is light weight, soft material and presents little likelihood of damage to the furniture or objects within the building in the vicinity of the players even if hit by the disc.

These and other objects will be apparent from the following description of a preferred embodiment of the invention, considered in conjunction with the following drawings.

BRIEF DESCRIPTION OF THE DRAWINGS

FIG. 1 is a perspective view showing two players enjoying a sailing disc and catch game utilizing a pair of catch batons and a thin, planar, unitary, soft nonwoven plastic fiber sailing disc forming a preferred embodiment of the present invention;

FIG. 2 is a perspective view of the, soft, light weight, non-woven plastic fiber sailing disc forming a major component of the game of the present invention;

FIG. 3 is a side elevational view thereof of the sailing disc FIG. 2; and FIG. 4 is a plan view of one of the catch batons illustrated in FIG. 1.

DETAILED DESCRIPTION OF THE PREFERRED EMBODIMENT

Reference is now made to the drawings in detail.

FIG. 1 shows two players 10 and 12, holding in one hand alike catch batons, indicated generally at 14, used for catching a soft, light weight, unitary non-woven plastic fiber thin sailing disc 16. The players stand facing each other at some distance apart. The players may adopt various stances or positions, however each of the players is required to throw the sailing disc 16 by grasping the same in one hand, along and by giving the peripheral edge thereof an inside out aim throwing motion, thus causing the disc 16 to rotate about its axis 18 as it leaves the first player 10 and passes along a path indicated by dotted lines 19 from the first player 10 to the second 12.

Upon reaching the second player 12, the second player utilizes his catch baton 14 to capture the light weight disc by surface contact therewith in a manner to be described hereinafter. The sailing disc 16 is immediately stopped in its flight, and remains attached to the catch baton 14 of the second player. The second player then uses his other hand to disengage the sailing disc from his baton 14 and sends it back to the first player 10 along the similar flight path in a similar manner.

That manner is best understood by an appreciation of the nature of tossing the hard thin molded plastic inverted saucer type sailing disc under the registered trademark FRISBEE®. As may be appreciated while in FIG. 1 there are only two players 10 and 12, three or more players may be engaged in tossing and catching one or more light weight soft, thin non-woven, plastic fiber sailing discs 16. It is also possible that a single person may throw the sailing disc 16 in some type of path which permits that person after the throwing the disc 16 to catch it by utilizing his catch baton 14 prior to landing on the ground G.

FIG. 2 shows, in an enlarged view, the soft, thin, non-woven plastic filter pad type fiber disc 16. That disc may be stamped out of large, wide porous sheets of non-woven plastic fiber material conventionally employed in making filters. Disk 16 is for example, approximately one half inch in thickness T, and having a diameter D on the order of six or eight inches. The non-woven plastic fibers are randomly positioned, intertwined within the mass of material making up disc !6, with the disc, being highly porous, of light weight and relatively small diameter. It can be readily thrown in the manner of a FRISBEE® sailing disc at relatively high speed but having little impact force since due to its low mass. The periphery **16*a* of the disc has a surface tecture which is the same as that of the top and bottom surfaces 16*b*, 16*c*. While, the diameter is approximately 8 inches for disk 16** and its thickness approximately one half an inch, the diameter D may range from 6 to 20 inches and the thickness T may vary by half an inch or more.

FIG. 4 shows in a plan view, one of the catch catons 14 illustrated in FIG. 1. The catch baton is formed principally of a wooden rod 20, which may be 12 inches in length and about 1½ times the diameter of the disk. A game may comprise an apparatus consisting of just two elements, a sailing disk axis 16 and a single catch baton 14. The catch baton has a proximate end **14*a*, which is grasped by the player while its opposite, distal end 14*b* carries a strip 22 of plastic or other material wrapped thereabout having an outer peripheral surface 22*a* from which projects a plurality of short length hook filaments 24. The strip 22 may be stapled by staples 26 to the outer periphery of the wooden rod 20 at its distal end 14*b*. Alternatively, or in conjunction with the staples 26, the interior surface of strip 22 may be adhesively adhered to the periphery of the rod 20**.

Preferably, the a proximate end **14*a* of the rod 20 carries a rubber end cap 28 which may be readily grasped by the player with rubber providing sufficient friction to prevent the rod from slipping out of the hand of the player during playing of the game. In the sailing disk and catch game apparatus, as exemplified by at least one sailing disk 16 and at least one catch baton 14, one component of the two component fastening system carried by or adhered to the catch baton 14 at a surface area of the releasable rod 20 at its distal end 14*b* and which has projecting outwardly therefrom, a plurality of short length hooks 24 and thus forms the hook component of a two component releasable fastening system. The other component is the equivalent to a loop type surface and is formed solely of the unitary non-woven plastic fiber, type filter material defining a soft thin disk whose individual fibers or filaments 30, FIG. 2, all about the exterior surface of the disk 16, are readily caught by the hooks 24 of strip 22 on the catch baton 14**.

The principal aspect and characteristic of the improved sailing disk of the game of this invention, is the fact that the disk itself weighs at most several ounces. Being so light weight and yet relatively rigid, it maintains its form when tossed in the fashion of a FRISBEE® inverted saucer like, thin plastic sailing disk which spins about its axis during travel when thrown by a player. The disk, in flight, as it approaches the player the player raises the catch baton, such that the short length kooks projecting outwardly about the full circumference of the rod 20 at its distal end 14*b* engages a number of the fibers on any one of the top surface 16*b*, bottom surface 16*c* and periphery 16*a* of disk 16, immediately stopping the disk from its travel.

The disc remains attached to the baton until manually disengaged therefrom by the catcher. While the strip 22 is identified as being formed of molded plastic with the hooks 24 integrally molded therewith, the strip may be of other form and may constitute a more conventional form of hook like VELCRO® hook material.

However, the make up of the disk 16 is specific to a relatively light weight, soft, highly porous, unitary non-woven plastic fiber pad of disk form which is relatively thin and whose diameter is on the order of 10 to 20 times the thickness of the disk.

From the foregoing, it should readily apparent that suitable apparatus have been described for carrying out the desired end whereby the hand propelling of the light weight, thin, relatively rigid, unitary non-woven plastic fiber pad of disk form and the catch batons having opposite type hook component releasable fastening means, readily releasably engage each other however, it is to be understood that modifications may be made to either the sailing disk or the catch batons or both without departing from the spirit and scope of this invention as defined by the claims appended hereto.

I claim:

1. A sailing disk and catch game comprising, in combination:

at least one hand held catch baton including an elongated rod for hand grasping by a player at a proximate end thereof, a strip of material fixably attached about the periphery of the rod at a distal end thereof, said strip having an outer surface bearing radially projecting short length hooks about the circumference of the strip,; and at least one thin planar hand throwable, soft, unitary, non-woven plastic fiber disk whereby;

the disk and the catch baton strip constitute a two component hook and loop releasable fastening system.

2. A sailing disk and catch game as claimed in claim 1, wherein said strip is formed of molded plastic.

3. A sailing disk and catch game as claimed in claim 1, wherein said at least one hand held catch baton are two in number.

4. A sailing disk and catch game as claimed in claim 1, wherein said at least one hand held catch baton further comprises a rubber end cap on said a proximate end of said rod.

5. A sailing disk and catch game as claimed in claim 1, wherein said rod comprises a wooden rod, and said strip is stapled to the outer periphery of the wooden rod at the distal end thereof.

6. A sailing disk and catch game as claimed in claim 1, wherein said sailing disk has a diameter in the range of 10 to 20 times the thickness of the disk.

7. A sailing disk and catch game as claimed in claim 6, wherein said disk is 8 inches in diameter and is approximately ½ inch in thickness and wherein said rod is approximately 12 inches in length.

* * * * *